US009522466B2

(12) United States Patent
Conway et al.

(10) Patent No.: US 9,522,466 B2
(45) Date of Patent: Dec. 20, 2016

(54) EXTENDABLE TOOL ATTACHMENT STICK

(71) Applicant: S.C. Johnson & Son, Inc., Racine, WI (US)

(72) Inventors: Simon M. Conway, Burlington, WI (US); Linda J. Babinski, Kenosha, WI (US); Kate Schreiber, Milwaukee, WI (US); Robert T. Wosewick, Shorewood, WI (US); Stephen M. Oshgan, Des Plaines, IL (US); Paresh Shroff, Palatine, IL (US); Jason R. Gebhardt, Buffalo Grove, IL (US); Tomasz K. Kasprzycki, Carpentersville, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 40 days.

(21) Appl. No.: 14/541,829

(22) Filed: Nov. 14, 2014

(65) Prior Publication Data

US 2015/0135454 A1 May 21, 2015

Related U.S. Application Data

(60) Provisional application No. 61/905,087, filed on Nov. 15, 2013.

(51) Int. Cl.
*B25G 1/04* (2006.01)
*A47L 13/20* (2006.01)

(52) U.S. Cl.
CPC . *B25G 1/04* (2013.01); *A47L 13/20* (2013.01)

(58) Field of Classification Search
CPC ..... B25G 1/04; A47L 13/24; A47L 13/253; A47L 13/258
USPC ..... 16/429; 15/147.1, 149, 143.1, 144.1, 15/144.3, 144.4
See application file for complete search history.

(56) References Cited

U.S. PATENT DOCUMENTS

| | | | | |
|---|---|---|---|---|
| 5,101,215 | A | 3/1992 | Creaser | |
| 5,322,334 | A * | 6/1994 | Hammer | B05B 15/064 15/144.4 |
| 5,881,601 | A * | 3/1999 | Hammer | B25G 1/04 294/210 |
| 7,774,901 | B1 * | 8/2010 | Huang | B25G 1/04 16/113.1 |
| 2005/0050663 | A1 | 3/2005 | Goulet | |
| 2005/0247523 | A1 | 11/2005 | Sewell | |
| 2010/0244475 | A1 * | 9/2010 | Hatcher | B25G 1/04 294/210 |

(Continued)

FOREIGN PATENT DOCUMENTS

| | | | | |
|---|---|---|---|---|
| EP | 2174577 | A1 | 4/2010 | |
| WO | WO 2015073829 | A1 * | 5/2015 | B25G 1/04 |

OTHER PUBLICATIONS

PCT/US2014/065714 International Search Report and Written Opinion dated Mar. 2, 2014.

*Primary Examiner* — Emily Morgan

(57) ABSTRACT

An extendable stick includes an elongate body comprising a first member, a second member, and a third member arranged in a telescopic nesting formation. A pulley system is disposed within the elongate body, wherein the pulley system is in operative communication with the first, second, and third members of the elongate body to extend the first member and the third member simultaneously outwardly from the elongate body and retract the first member and the third member simultaneously inwardly from the elongate body.

15 Claims, 14 Drawing Sheets

(56) References Cited

U.S. PATENT DOCUMENTS

2010/0281642 A1* 11/2010 Lee ..... A01K 23/005
15/144.4
2015/0135454 A1* 5/2015 Conway ..... B25G 1/04
15/144.4

* cited by examiner

EXTENDABLE TOOL ATTACHMENT STICK

CROSS-REFERENCES TO RELATED APPLICATIONS

This application claims priority from U.S. Patent Application No. 61/905,087 filed Nov. 15, 2013.

STATEMENT REGARDING FEDERALLY SPONSORED RESEARCH

Not Applicable.

BACKGROUND OF THE INVENTION

1. Field of the Invention

The invention relates generally to a stick system and more particularly to a telescoping stick system.

2. Description of the Related Art

Various stick systems are known in which a length of a stick can be extended and/or retracted throughout various modes of operation. Such stick systems can be found in a variety of applications, including, merely by way of example, being integrated in furnishings such as couches, tables, beds, tension rods, utilized as instruments for painting, wiping, and grasping items from a distance, and the like. Commonly, one or both ends of the stick secure a tool, such as a claw that can be manipulated from an opposing end of the stick by a user. In that case, the stick can be extended to place the tool in a desired location that is distal from the user. The tool facilitates operation by the user on the distal location, such as an area to be cleaned or an object to be retrieved, without requiring a ladder or other means to contact such distant, typically hard-to-reach places. In other aspects, the stick system is practical for storage considerations by obviating the need for an elongate storage space since the stick is collapsible.

Typically, existing stick systems provide more than one extendable segment and require the user to assemble each segment at a time. Such devices are cumbersome and time-consuming. Other stick systems have an external, geared actuator that extends the stick in one direction. Still, other stick systems have a toothed wheel that rotates along a toothed rack to extend and/or retract stick segments relative to each other. Those stick systems can be large, heavy and unpractical for a variety of operations, such as handheld operation.

Therefore, there exists a need for an extendable and retractable stick system that addresses the above concerns and provides related advantages.

SUMMARY OF THE INVENTION

In one embodiment, an extendable stick includes an elongate body comprising a first member, a second member, and a third member arranged in a telescopic nesting formation. A pulley system is disposed within the elongate body, wherein the pulley system is in operative communication with the first, second, and third members of the elongate body to extend the first member and the third member simultaneously outwardly from the elongate body and retract the first member and the third member simultaneously inwardly from the elongate body.

In another embodiment, the first, the second, and the third members are nested in order of increasing cross-sectional diameter. The first member defines a smallest diameter and the third member defines a largest diameter.

In another embodiment, the second member is stationary.

In another embodiment, an attachment head is disposed on a first end of the first member. The attachment head is configured to receive a releasably secured attachment tool. A handle is disposed on a second end of the third member opposing the first end of the first member.

In still another embodiment, the extendable stick includes a button assembly configured to lock the elongate body in a collapsed position, an extended position, and a plurality of positions between the collapsed position and extended position.

In yet another embodiment, the elongate body further includes a fourth member.

In another embodiment, the first, second, and third members are arranged in the telescopic nesting formation within the fourth member when the elongated body is in a collapsed configuration.

In still another embodiment, the first and third members project outwards from an anterior end and a posterior end of the fourth member when the elongate body is in an extended configuration.

In yet another embodiment, an extendable stick includes an elongate body comprising a first member, a second member, and a third member arranged in a telescopic nesting formation within a fourth member. An attachment head is disposed on a first end of the first member. The attachment head is configured to receive a releasably secured attachment tool. A handle is disposed on a second end of the third member opposing the first end of the first member. A pulley system is disposed within the elongate body and includes an anterior wheel disposed within a fourth end cap disposed on a first end of the second member and a posterior wheel disposed within a second end cap disposed on a second end of the second member. The pulley system further includes one or more string members in communication with a first end cap, a third end cap, the anterior wheel, and the posterior wheel. In a collapsed configuration the first end cap is proximate the second end cap and the third end cap is proximate the fourth end cap. In an extended configuration the first end cap is proximate the fourth end cap and the third end cap is proximate the second end cap.

In still another embodiment, the first end cap passes through the third end cap when the elongate body is transitioned from the collapsed configuration to the extended configuration.

In another embodiment, the first end cap is disposed on a second end of the first member and the third end cap is disposed on the first end of the third member.

In still another embodiment, the second member is stationary within the fourth member when the elongate body is transitioned from the collapsed configuration to the extended configuration.

In yet another embodiment, a first end of a first string member is connected to the first end cap. A second end of the first sting member is connect to the third end cap. A first end of a second string is connected to the first end cap. A second end of the second string is connected to the second end cap. The first string is in communication with the anterior wheel and the second string is communication with the posterior wheel.

In another embodiment, the first member, the second member, and the third members are nested in order of increasing cross-sectional diameter, whereby the first member defines a smallest diameter and the third member defines a largest diameter.

In still another embodiment, the extendable stick further includes a button assembly configured to lock the elongate body in the collapsed position, the extended position, and a plurality of positions between the collapsed position and extended position.

In yet another embodiment, an extendable stick includes an elongate body comprising a first member, a second member, and a third member arranged in a telescopic nesting formation. The first member is dimensioned to fit within the second member. The second member is dimensioned to fit within the third member. The third member is dimensioned to fit within a fourth member. An attachment head is disposed on a first end of the first member. The attachment head is configured to receive an attachment tool releasably secured thereto. A handle is disposed on a second end of the third member opposing the first end of the first member. A button assembly is disposed on the fourth member. A pulley system is disposed within the elongate body. The pulley system is in operative communication with the first, second and third members of the elongate body to extend the first member and the third member simultaneously outwardly from the elongate body and retract the first member and the third member simultaneously inwardly from the elongate body.

In another embodiment, the button assembly is configured to lock the elongate body in a collapsed position, a extended position, and a plurality of positions between the collapsed position and extended position.

In still another embodiment, the third member includes a plurality of holes. The button assembly is configured to be in communication with one of the plurality of holes when the elongate body is configured to be in one of the collapsed position, the extended position, and the plurality of positions between the collapsed position and extended position.

In yet another embodiment, the second member is stationary within the fourth member when the first and third members are simultaneously extended or retracted to configure the elongate body in one of the collapsed position, the extended position, and the plurality of positions between the collapsed position and extended position.

In another embodiment, the attachment tool is one of a broom head, a mop head, and a dusting head.

These and other features, aspects, and advantages of the present invention will become better understood upon consideration of the following detailed description and drawings.

BRIEF DESCRIPTION OF THE DRAWINGS

Like reference numerals will be used to refer to like parts from Figure to Figure in the following detailed description.

DETAILED DESCRIPTION OF THE INVENTION

Figure 1:
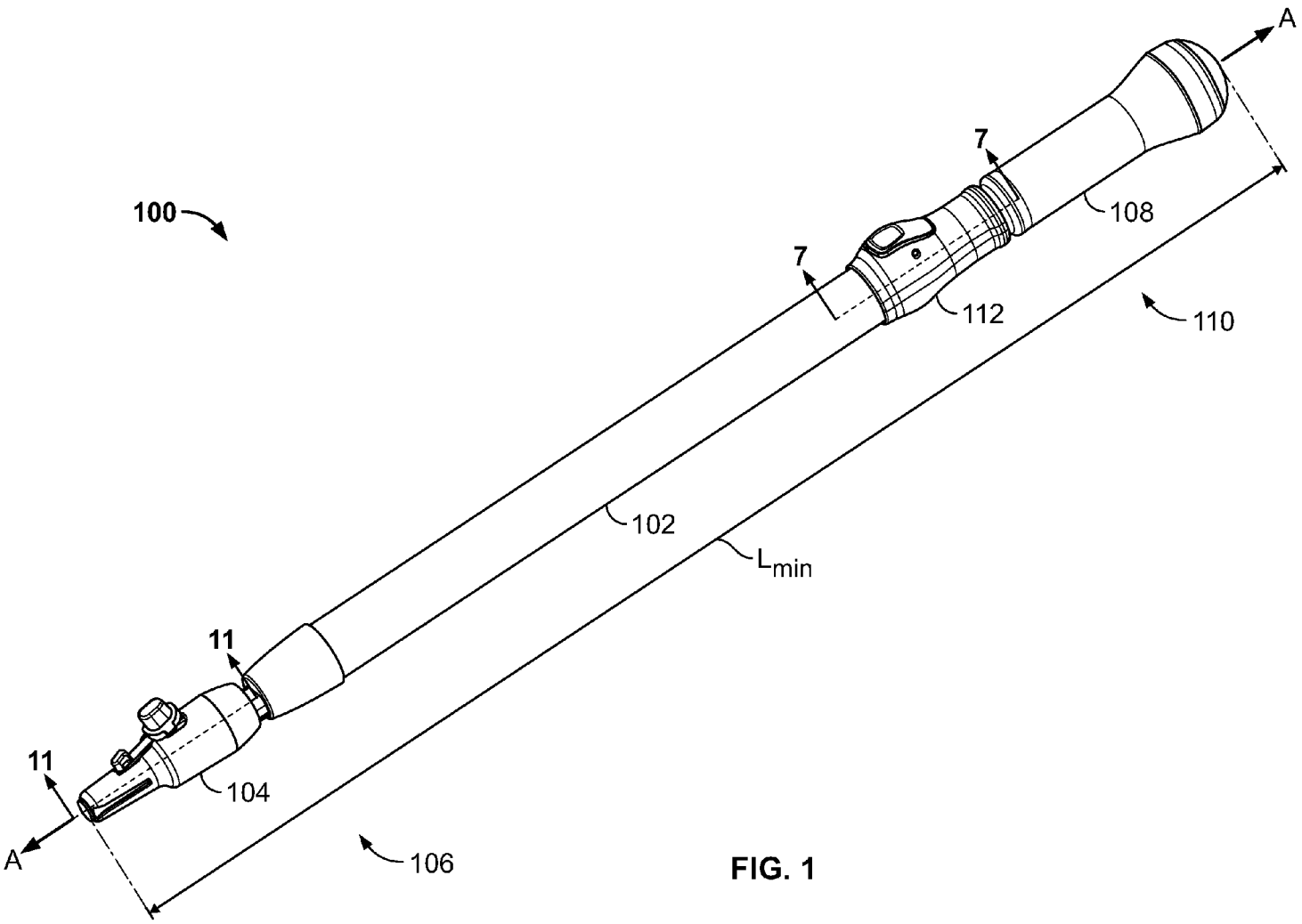
FIG. 1 is a front, left and top perspective view of an extendable stick in a retracted position.
Figure 2:
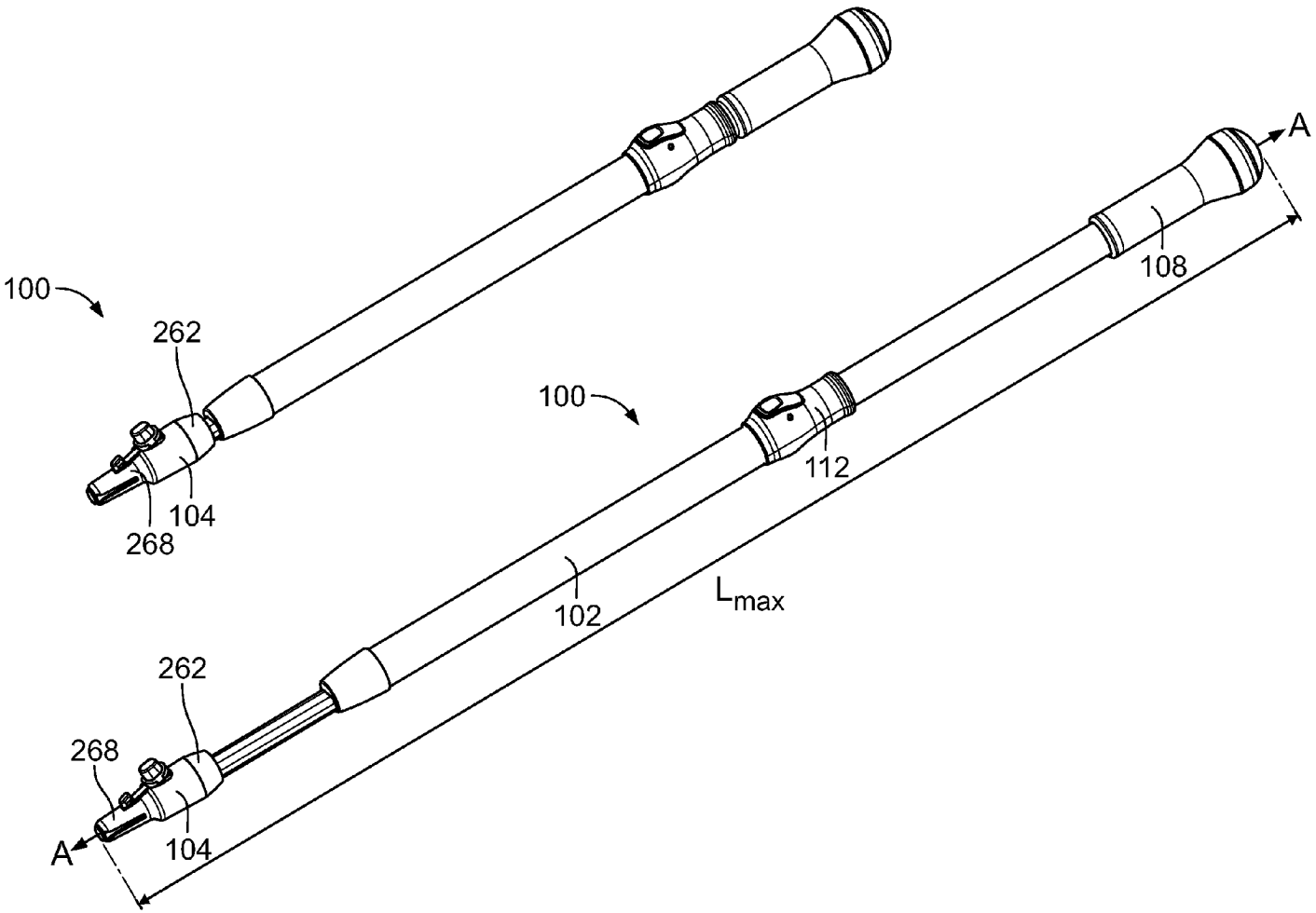
FIG. 2 is a front, left and top perspective view of the extendable stick of FIG. 1 in an extended position.

The following description discloses various embodiments for a telescoping stick that is suitable for a variety of uses, including, but not limited to, household, industrial and institutional cleaning applications. In particular, FIGS. 1 and 2 illustrate an extendable stick 100 in a retracted (or closed) state and an extended (or open) state, respectively. The extendable stick 100 comprises an elongate body 102 that is generally tubular-shaped and straight. An attachment head 104 is disposed on one end, such as an anterior end 106, of the elongate body 102. An ergonomically-formed handle 108 is disposed on an opposing end, such as a posterior end 110, of the elongate body 102. As shown in the retracted position in FIG. 1, a button assembly 112 is disposed on the elongate body 102 near the handle 108 of the extendable stick 100. However, it is noted that the button assembly 112 can be disposed at any location between the attachment head 104 and the handle 108 in the closed position, for instance, adjacent to the attachment head 104. Together, the elongate body 102, the attachment head 104, the handle 108, and the button assembly 112 define a straight path along a common central axis A of the extendable stick 100.

In FIG. 1, the retracted state of the elongate stick 100 defines a minimum length, $L_{min}$, between outermost ends of the stick 100, namely between an outermost edge of the attachment head 104 and an outermost edge of the handle 108. In FIG. 2, the fully extended state of the elongate stick 100 defines a maximum length, $L_{max}$, between the outermost edges of the attachment head 104 and the handle 108. It is noted that an infinite number of intermediate lengths, $L_{int}$, can defined by the extendable stick 100, whereby $L_{min}<L_{int}<L_{max}$. It is contemplated that an extension ratio $R_E$ defined by $L_{max}$:$L_{min}$ is between about 3:2 to about 3:1. In one embodiment, the extension ratio $R_E$ is about 9:5. In operation, the various lengths $L_{min}$, $L_{int}$, and $L_{max}$ of the extendable stick 100 can be set by retracting the anterior and posterior ends 106,110 simultaneously inwardly and/or by extending the ends simultaneously outwardly until a desired length is reached. In this manner, the elongate stick 100 is telescopic in two directions, such as inwardly and outwardly at both anterior and posterior ends 106,110 along the central axis A, as opposed to telescoping from a single end in a single direction. The desired length can be secured by a locking mechanism that prevents the stick from unintentionally collapsing during use, as described in further detail below.

Figure 3A:
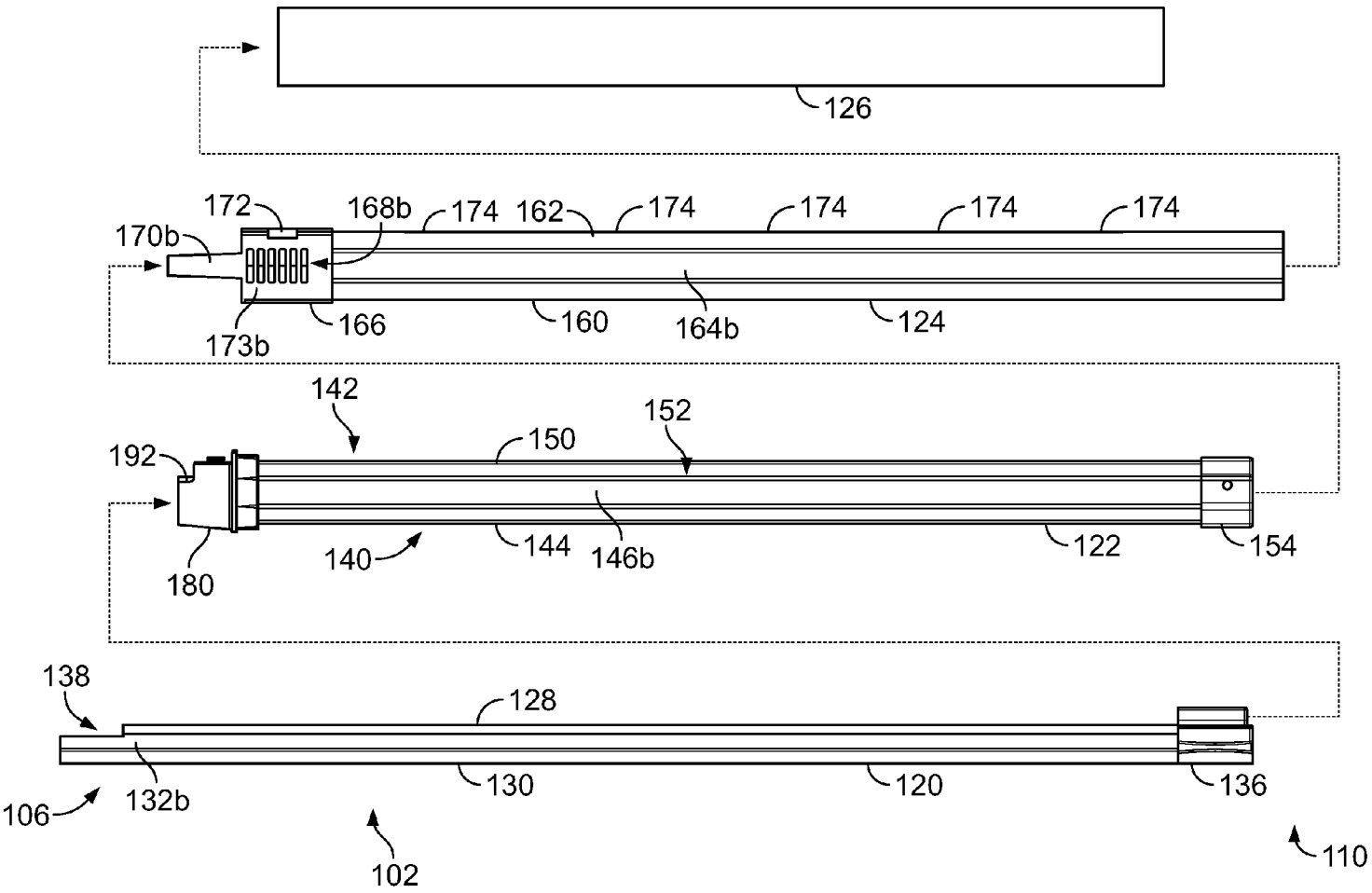
FIG. 3A is an exploded view of a first, second, third, and fourth member of the extendable stick in FIG. 1.

Turning now to FIG. 3A, an exploded view of the elongate body 102 is shown. The elongate body 102 comprises a plurality of members, including a first member 120, a second member 122, a third member 124, and a fourth member 126. The plurality of members 120,122,124,126 are adapted to be nested together in the retracted position, such that the first member 120 is the innermost member and the fourth member 126 is the outermost member that generally houses all of the members 120,122,124 in the retracted position shown in FIG. 1.

As shown in FIG. 3A, each of the members 120,122,124,126 is elongate and tubular in shape with a generally constant cross-sectional diameter defined along the central axis A. For instance, the cross-sectional diameters toward the ends of the members 120,122,124,126 may be larger or smaller than central portions thereof to accommodate other functionalities, as described further below, without compromising the telescopic mechanism described herein. Further, the cross-sectional diameters vary among the members 120,122,124,126 to permit a nesting configuration thereof. For instance, the innermost first member 120 comprises a narrowest diameter among the members 120,122,124,126; the second member 122 comprises a slightly larger cross-sectional diameter for nesting the first member 120 therein; the third member 124 comprises an even larger diameter than the second member 122 for receiving the second member 122 therein; the fourth member 126 comprises the largest diameter to permit nesting of the third member 124. Further, the cross-sectional diameters of the members 120,122,124,126 may be adapted to facilitate smooth extension and retraction of the elongate stick 100, for instance, by providing a circumferential gap or spacing between each nested member 120,122,124,126 to eliminate frictional resistance, grinding or scraping between the members 120,122,124,126.

It is noted that the cross-sectional shape can vary among the members 120,122,124,126, as will be described further below. It is further noted that the members 120,122,124,126 may comprise approximately the same or different lengths along the central axis A. In one embodiment, all of the members 120,122,124,126 are the same length and fit entirely inside the fourth member 126 in the retracted position without any portion of the inner members 120,122,124 protruding from ends thereof. In a different embodiment, some or all of the members 120,122,124 have end portions that project from the end portions of the fourth member 126, or any other member it is nested within, such that the members 120,122,124,126 are not housed entirely inside the fourth member 126. In the present embodiment, as shown below, end portions of the first member and the third member protrude from the anterior end 106 and the posterior end 110, respectively, of the fourth member 126. In a different aspect, the members 120,122,124,126 are formed from a lightweight and strong metal, a metal alloy such as aluminum alloys, or a durable plastic. Various alternatives for cross-sectional shape, length, diameter, material and the like can be contemplated without compromising the present disclosure.

Figure 4:
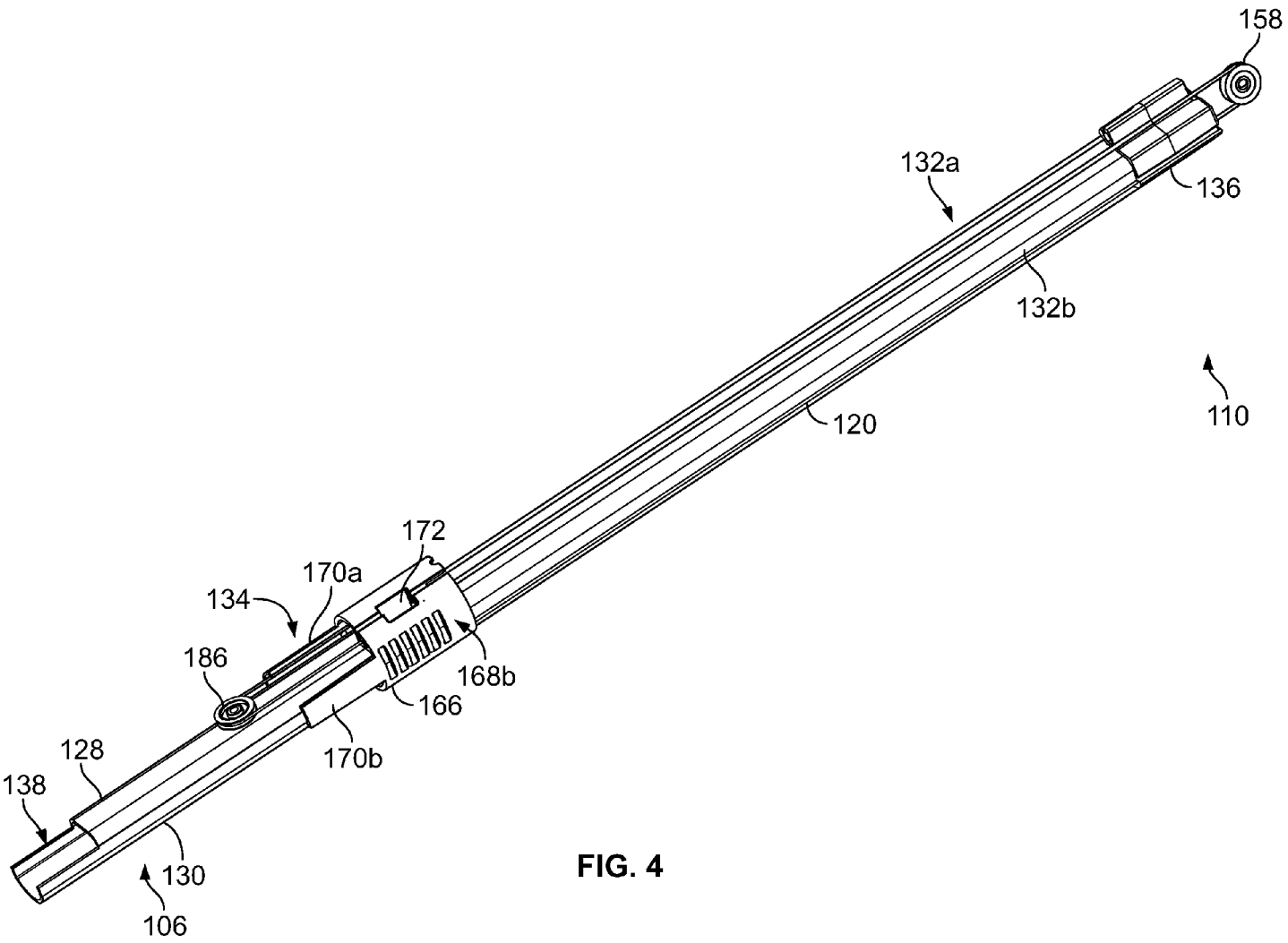
FIG. 4 is a front, left and top perspective view of the extendable stick of FIG. 1 having the first member and the pulley system.

Referring to FIGS. 3A and 4, the first member 120 is an elongate, hollow column having a D-shaped cross-sectional profile comprising a flat top 128, a curved bottom 130 that is generally semi-circular in shape, and two flat sidewalls 132*a*,132*b* connecting the top 128 to the bottom 130. The flat top 128 allows portions of a pulley system 134 to run parallel thereto toward a first end cap 136, which is press-fit into the posterior end 110 of the first member 120. The two flat sidewalls 132*a*,132*b* facilitate aligning the first member 120 to the inside of the second member 122 and preventing significant rotation of the first member 120 therein. A cut-out 138 is provided in a portion of the flat top 128 at the anterior end 106 to accommodate other components, as the described further below.

Figure 5:
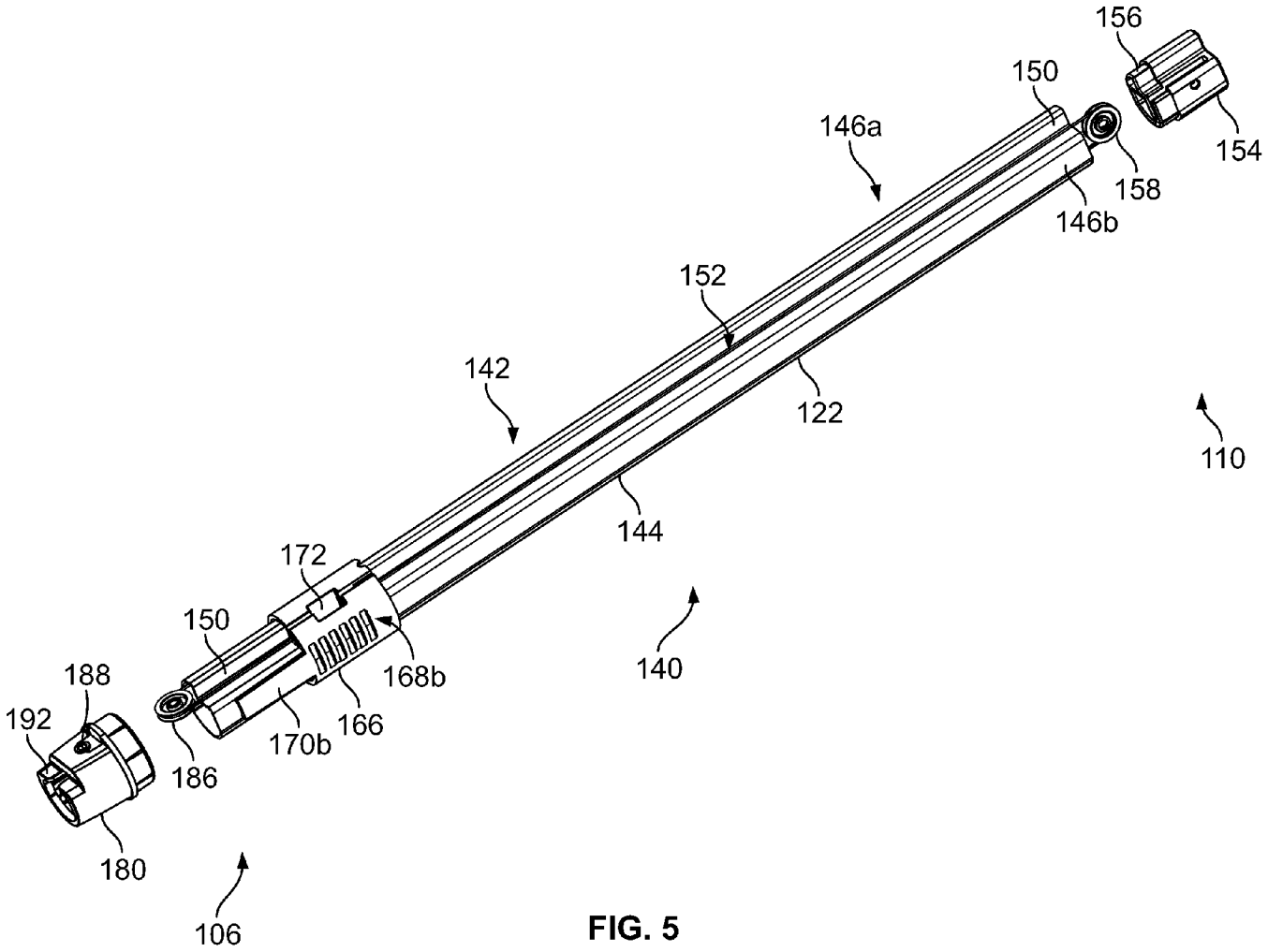
FIG. 5 is a front, left and top perspective view of the extendable stick of FIG. 1 having the second member and the pulley system.

As shown in FIGS. 3A and 5, the second member 122 is an elongate, hollow tube having a lower portion 140 that is shaped corresponding to the geometry, such as the cross-sectional geometry, of the first member 120 inserted therein and an upper portion 142 that accommodates various portions of the pulley system 134. In a particular embodiment, the second member 122 comprises a curved bottom 144 with flat sidewalls 146*a*,146*b* to house the first member 120 therein and the upper portion 142 comprising a tunnel 150 for accommodating wiring of the pulley system 134 therethrough. In the present embodiment, the tunnel 150 is a fluid extension of the hollow space adapted to receive the first member 120. The upper portion 142 further defines an elongate trough 152 adjacent to the tunnel 150 to further accommodate wiring of the pulley system 134 therealong. In an aspect, the top portion provides a two-way highway for travel of wiring in the pulley system 134, as described in detail below.

Further, a second end cap 154 is provided at the posterior end 110 of the second member 122 by press-fitting a recessed portion 156 of the cap 154 (see FIG. 5) into the second member 122. It is contemplated that the second end cap 154 supports thereto a posterior wheel 158 of the pulley system 134, described in further detail below. Further, the recessed portion 156 is positioned adjacent to the first end cap 136 when the extendable stick 100 is in the nested or retracted configuration. During an extension of the extendable stick 100, the first end cap 136 moves away from the stationary, second end cap 154. During retraction, the first end cap 136 moves toward the second end cap 154 and may be stopped by the second end cap 154 from further retraction. In the present embodiment, the second member 122 is shorter in length than the first member 120 to expose portions of the first member 120, such as an anterior portion 106 thereof, in the retracted position to allow for attachment of other features thereto, as described below.

Figure 6:
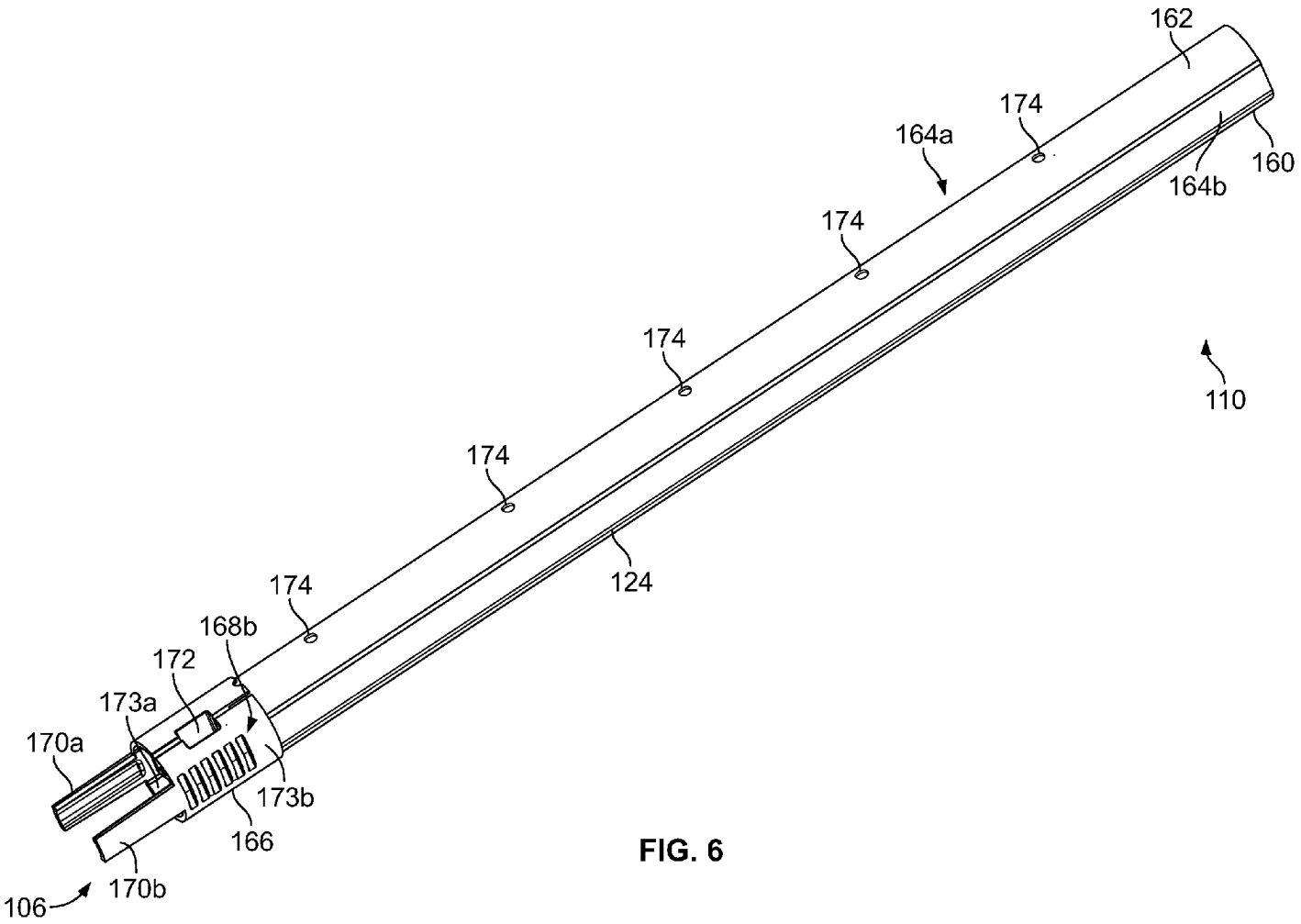
FIG. 6 is a front, left and top perspective view of the third member of the extendable stick of FIG. 1.

Referring to FIGS. 3A and 6, the third member 124 is an elongate, hollow tube having a curved bottom 160, a curved top 162, and two opposing flat sidewalls 164*a*,164*b*, disposed therebetween. The geometry of the third member 124 is adapted to receive the second member 122 telescoping therein. A third end cap 166 is press-fit over the anterior end 106 of the third member 124 and comprises two opposing grooved portions 168*a*,168*b* and two opposing flanges 170*a*, 170*b* that are aligned with the flat sidewalls 164*a*,164*b* of the third member 124. As such, the third end cap 166 is a generally cylindrical segment that comprises an inner diameter slightly larger than the outer diameter of the third member 124. Further, the third end cap 166 provides a channel 172 in communication with the elongate trough 152 of the second member 122 to receive the wiring of the pulley system 134 passing therethrough. In another aspect, the third end cap 166 functions as a transitional piece, whereby the inner geometry 173*a* corresponds to the outer geometry of the third member 124 having the flat sidewalls 164*a*,*b* and the outer geometry 173*b* of the third end cap 166 is generally cylindrical. As further shown in FIG. 6, the curved top 162 of the third member 124 comprises a plurality of holes 174 for interaction with a locking mechanism of the button assembly 112, as described in further detail below. In the present embodiment, the holes 174 are evenly spaced. It is noted that any spacing configuration and/or number of holes 174 can be provided.

Referring again to FIGS. 3A and 5, the fourth member 126 comprises an elongate, hollow and generally cylindrical tube having the largest cross-sectional diameter due to its outermost position. The fourth member 126 is adapted to receive the third member 124 and the third end cap 166 telescoping therethrough. In an aspect, the cylindrical outer geometry 173*b* of the third end cap 166 is adapted to slide along and be guided by an inner cylindrical wall of the fourth member 126 during extension and retraction of the elongate body 102. A fourth end cap 180 having a recessed portion 182 is press-fit into the anterior end 106 of the fourth member 126. It is contemplated that in the retracted position as shown in FIG. 1, the recessed portion 182 of the fourth end cap 180 is placed adjacent to tips of the flanges 170*a*,170*b* extending axially from the third member 124. During an extension of the extendable stick 100, the third end cap 166 moves away from the stationary, fourth end cap 180. During retraction, the third end cap 166 moves back toward the fourth end cap 180 and may be stopped by the fourth end cap 180 from retracting further.

Figure 12:
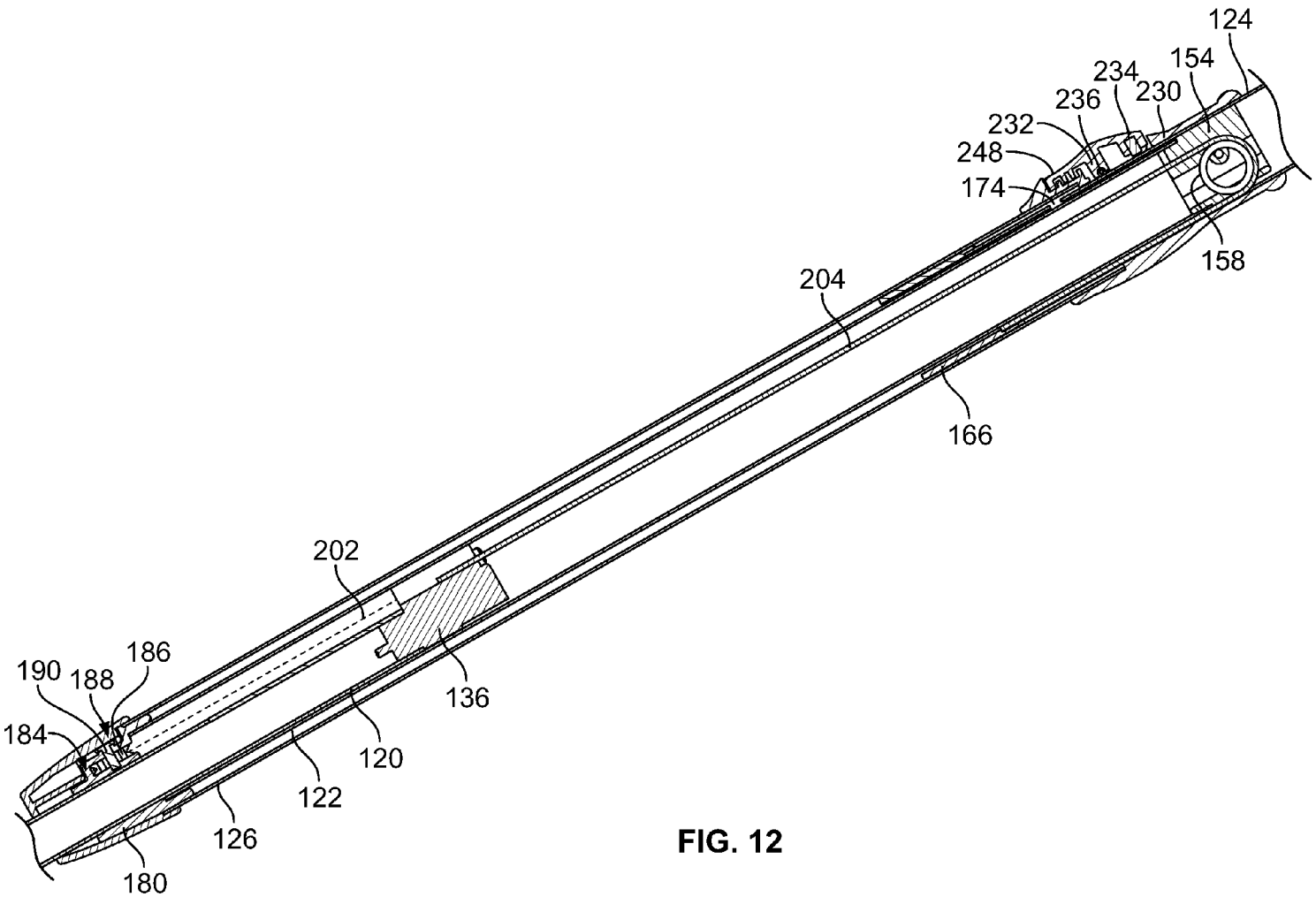
FIG. 12 is a schematic diagram of the extendable stick of FIG. 1 in the extended position.

In another aspect, the fourth end cap 180 comprises an inner slot 184 (see FIG. 12) for receiving an anterior wheel 186 and a pinhole 188 for receiving a pin captive 190 (see FIGS. 9, 10 and 12) that secures the rotational axis of the wheel 186 therein. Turning back to FIGS. 3A and 5, the fourth end cap 180 comprises a step-down portion 192 that corresponds to the D-shaped geometry of the first member 120, which slides therethrough during extension and retraction of the elongate body 102.

It is noted that the various end caps 136,154,166,180 described above can be formed from plastic materials and can be press-fit or mechanically attached to their corresponding members 120,122,124,126 in a variety of manners well known in the art, including screws, threads, adhesive bonds, or a combination thereof, and other means.

Figure 3B:
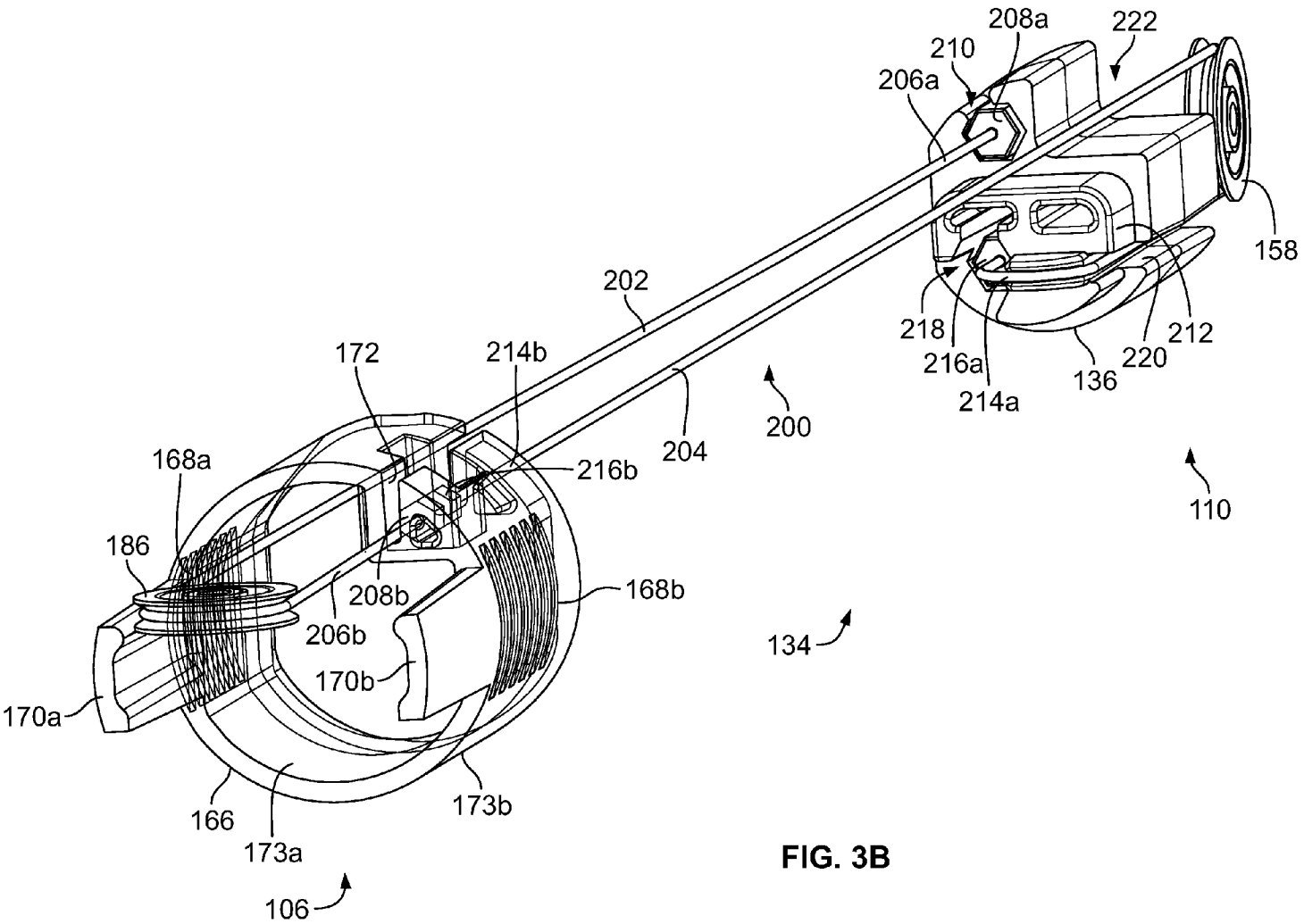
FIG. 3B is an close-up view of a pulley system of the extendable stick in FIG. 1.

Turning now to FIG. 3B, the pulley system 134 that operatively extends and retracts the extendable stick 100 is shown in detail. The pulley system 134 comprises the posterior wheel 158 and the anterior wheel 186, which are disposed perpendicularly relative to each other and spaced apart (see FIG. 12). In an aspect, the anterior wheel 186 is positioned to lie parallel above the anterior end 106 of the flat top 128 on the first member 120, as shown in FIG. 4, and the posterior wheel 158 is positioned transversely thereof beyond an opposing end of the first member 120. Further, the posterior wheel 158 is housed inside the second end cap 154 shown in FIG. 3A and the anterior wheel 186 is housed inside the fourth end cap 180 shown in FIG. 3A. The second and fourth end caps 154, 180 are stationary and do not move relative to one another. Therefore the posterior and anterior wheels 158, 186 of the pulley system 134 do not move either, thus defining a constant space or gap between the wheels 158, 186.

Referring again to FIG. 3B, a wiring assembly 200 is provided in the pulley system 134 for operative communication between the posterior wheel 158 and the anterior wheel 186. The wiring assembly 200 may comprise a single length of string or a plurality of string segments in operative communication with one another. In the present embodiment, two string segments are provided as an anterior string 202 that wraps around the anterior wheel 186 and a posterior string 204 that wraps around the posterior wheel 158.

Still referring to FIG. 3B, the anterior string 202 terminates at a first end 206*a* with a turnbuckle 208*a* that is press-fit into a correspondingly-shaped upper turnbuckle slot 210 disposed above a recessed portion 212 on the first end cap 136. The recessed portion 212 is press-fit into the posterior end 110 of the first member 120, as shown FIG. 3A, such that the turnbuckle 208*a* protrudes above the posterior end 110 of the first member 120. Accordingly, the anterior string 202 attached thereto is disposed across the flat top 128 of the first member 120 (see FIG. 4) and runs through the tunnel 150 defined by the upper portion 142 of the second member 122 (see FIG. 5). The anterior string 202 engages around the rotatable anterior wheel 186 and terminates at a second end 206*b* with a second turnbuckle 208*b*. The second turnbuckle 208*b* is secured in the channel 172. Since the first end cap 136 and the third end cap 166 are attached to opposing first and second ends 206*a*,206*b* of the anterior string 202 with the anterior wheel 186 disposed therebetween, the end caps 136, 166 are alternately leading and trailing one another in opposite directions during extension and retraction operations. Further, in the present embodiment, the first end cap 136 comprises a smaller outer profile or cross-sectional diameter than the cross-sectional diameter on the inner geometry 173*a* of the third end cap 166, such that the first end cap 136 passes through the third end cap 166 at a point intermediate between the anterior wheel 186 and the posterior wheel 158.

Referring again to FIG. 3B, the posterior string 204 is configured to wrap around the posterior wheel 158. A first end 214*a* of the posterior string 204 terminates with a first turnbuckle 216*a* that is press-fit into a correspondingly-shaped lower turnbuckle slot 218 disposed generally below the upper turnbuckle slot 210 described above. The lower turnbuckle slot 218 is positioned adjacent to the recessed portion 212 of the first end cap 136 and wraps around the recessed portion 212 through a lower passageway 220 toward the posterior wheel 158. The posterior string 204 then wraps around the posterior wheel 158 and continues across an upper passageway 222 toward the third end cap 166. In the present embodiment, the upper passageway 222 is an L-shaped groove that is formed above the recessed portion 212 such that the posterior string 204 passes parallel and above the first member 120 (see FIG. 4) toward the third end cap 166. A second end 214*b* of the posterior string 204 terminates with a second turnbuckle 216*b* that is inserted in the channel 172 of the third end cap 166 and adjacent to the second turnbuckle 208*b* of the anterior string 202. Therefore, the third end cap 166 serves as a transitional piece or connecting piece for the wiring assembly 200 that operatively connects the anterior and posterior string 202,204.

It is noted that FIG. 3B illustrates the pulley system 134 in a fully or close-to-fully retracted position, whereby the members 120,122,124,126 are nested together and the overall length of the extendable stick 100 is at the minimum, $L_{min}$. In this state, the first end cap 136 is positioned near the posterior pulley 158 and the third end cap 166 is positioned near the anterior pulley 166. During extension, the third end cap 166 is pulled toward the posterior wheel 158, which pulls the first end cap 136 toward the anterior wheel 186. It is noted that either first or third end cap 136,166 can be a leading or trailing element, depending on which one is being pulled by a user, as described in further detail below.

Figure 7:
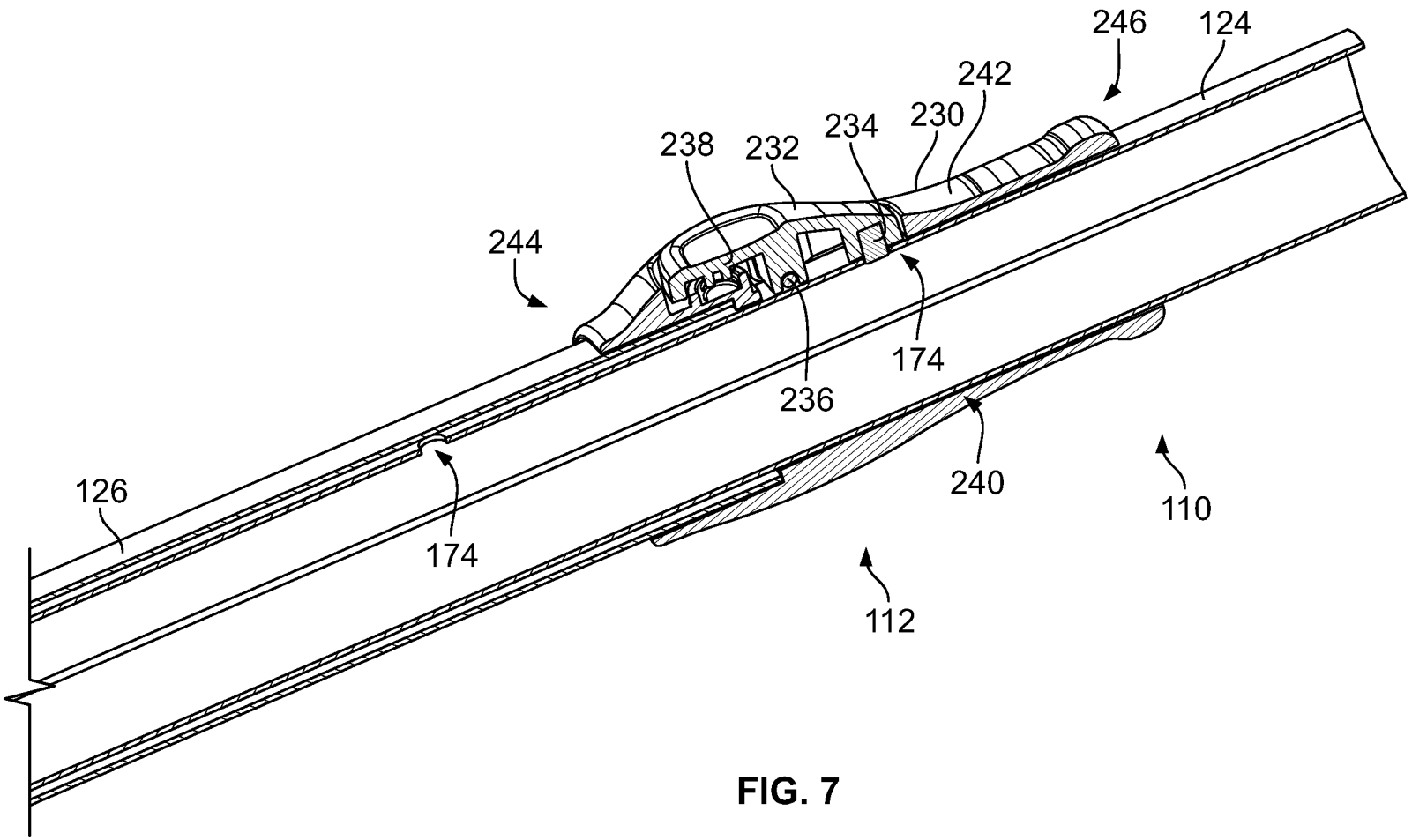
FIG. 7 is cross-sectional view of a button assembly deployed on the third and fourth members of the extendable stick of FIG. 1 taken generally along line 7-7 of FIG. 1.

Turning now to FIG. 7, a cross-sectional view of the button assembly 112 disposed on the third and fourth members 124, 126 is provided. The button assembly 112 comprises a button cap 230 for housing a button 232, a pin 234 for insertion into the plurality of holes 174 provided on the third member 124, a rocker 236, and a spring 238. In particular, the button cap 230 is tubular shaped with an inner hollow channel 240 extending therethrough and an outer curvilinear outer surface 242 that generally tapers from a forward half 244 to a rearward half 246. The fourth member 126 is secured permanently and immovably to the forward half 244 and the third member 124 of lesser diameter protrudes through the rearward half 246 and slides therethrough.

In operation, the button assembly 112 provides a locking and securing mechanism that prevents the extendable stick 100 from inadvertently collapsing or extending during use. In particular, if a user wishes to extend or contract the extendable stick 100, the user presses the button 232 at an indicated surface 248, which may be indented as shown in the present embodiment and/or marked with grooves or other surface treatments. It is contemplated that the user may grasp the fourth member 126 near the forward half 244 of the button cap 230 and press the button 232 with the user's thumb in the same hand, and with the remaining hand pull the handle 108 (see FIG. 1) out of the fourth member 126. Since the handle 108 is attached to the posterior end 110 of the third member 124, the third member 124 and the third end cap 166 are forced to travel toward the button cap 230 and the second end cap 154, which in the present embodiment is disposed within the rearward half 246 of the button cap 230. The movement of the third end cap 166 in this manner causes the first end cap 136 to move in an opposite direction toward the fourth end cap 180 (see FIG. 3A), thereby extending the first member 120 out of the fourth member 126. Further, it is contemplated that the button 232 may be treated with a different surface texture or color to differentiate from the button cap 230 and other components of the extendable stick 100 to facilitate quick identification of the button to the user. In another aspect, the user can simply press the button 232 and allow gravity to affect a downward force on the first member 120 and first end cap 136, thereby causing the third end cap 166 and the third member 124 to extend upwardly out of the fourth member 126.

Still referring to FIG. 7, depression of the button 232 causes the button 232 to pivot toward the forward half 244 of the button cap 230 as the button 232 rotates about the rocker 236, which is a bar secured to the button cap 230. The button 232 transfers the downward force to compress the spring 238, which is configured to bias the button out of the button cap 230. The rocking motion of the button 232 allows the release of the pin 234 from the hole 174 currently engaged so that the third member 124 is free to slide in or out of the fourth member 126 and the button cap 230. Once a desired length is established corresponding to one of the plurality of holes 174, the user releases the button 232 to lock the pin 234 into the desired hole 174 and thereby secure the length of the extendable stick 100. It is contemplated that a user indication, such as an auditory click, is provided when the lock is in place to indicate to the user that the extendable stick 100 is properly locked.

Figures 8A, 8B:
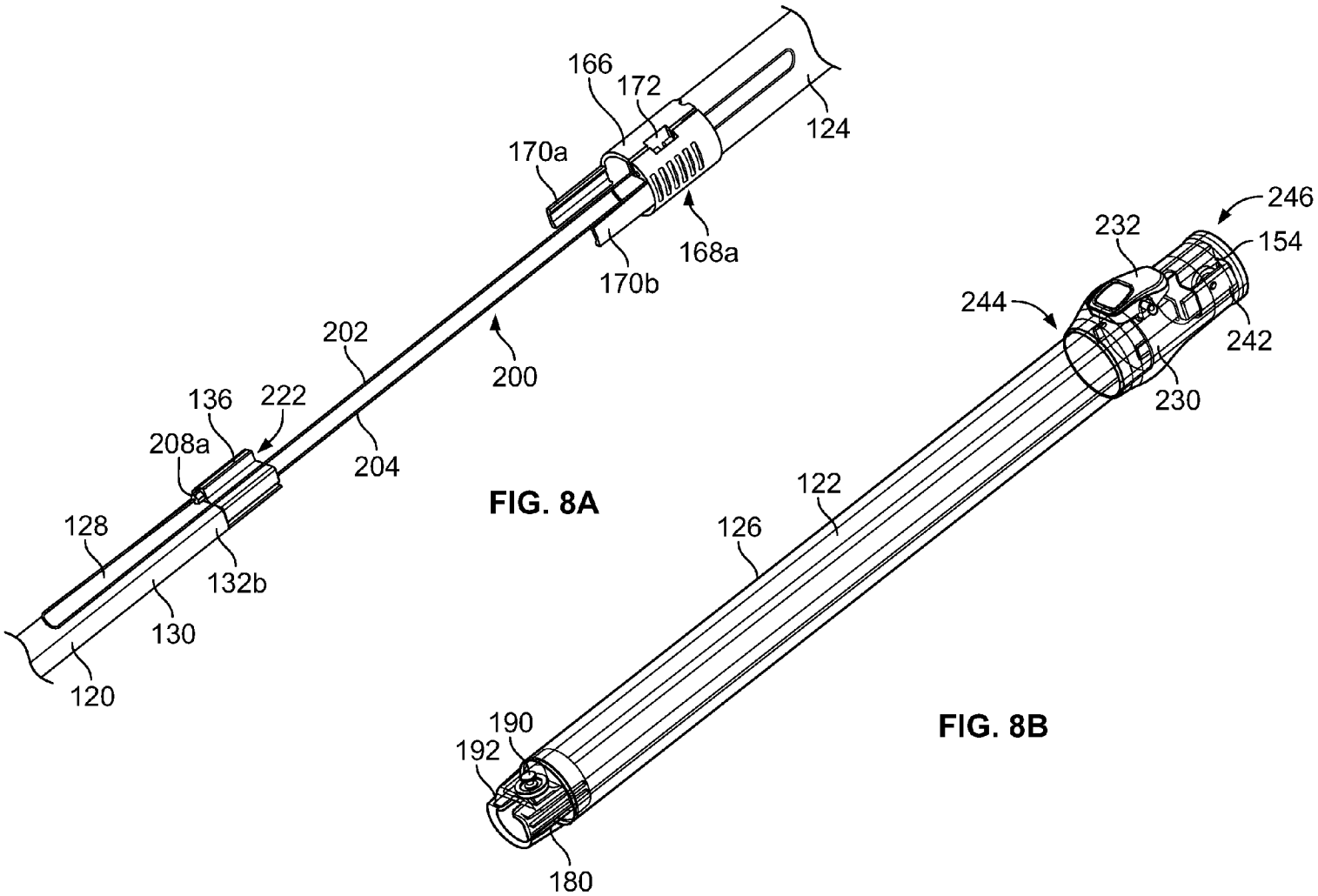
FIG. 8A is a front, left and top perspective view of a moveable parts assembly of the extendable stick of FIG. 1.
FIG. 8B is a front, left and top perspective view of a stationary parts assembly of the extendable stick of FIG. 1.

FIGS. 8A-10B further illustrate the telescoping mechanism described above for the extendable stick 100 that provides a double-acting effect to extend both ends of the stick 100 simultaneously and to contract both ends of the stick 100 simultaneously. FIG. 8A illustrates moveable components of the extendable stick 100, which include the first end cap 136 adhered to the first member 120 moving together as a single unit, and the third end cap 166 adhered to the third member 124 moving together as a single unit. Both end caps 136,166 house the ends of the two anterior and posterior strings 202,204. FIG. 8B illustrates stationary components of the extendable stick 100, which include the second end cap 154 adhered to the second member 122 and the fourth end cap 180 adhered to the fourth member 126. Further, the button cap 230 is adhered to the fourth member 126 at an end opposite to the fourth end cap 180. Specifically, in the present embodiment, the forward half 244 of the button 230 houses the fourth member 126 and the rearward half 246 houses the second end cap 154 therein. Even further, the second end cap 154 houses the posterior wheel 158 and the fourth end cap 180 houses the anterior wheel 186.

Figures 9A, 9B:
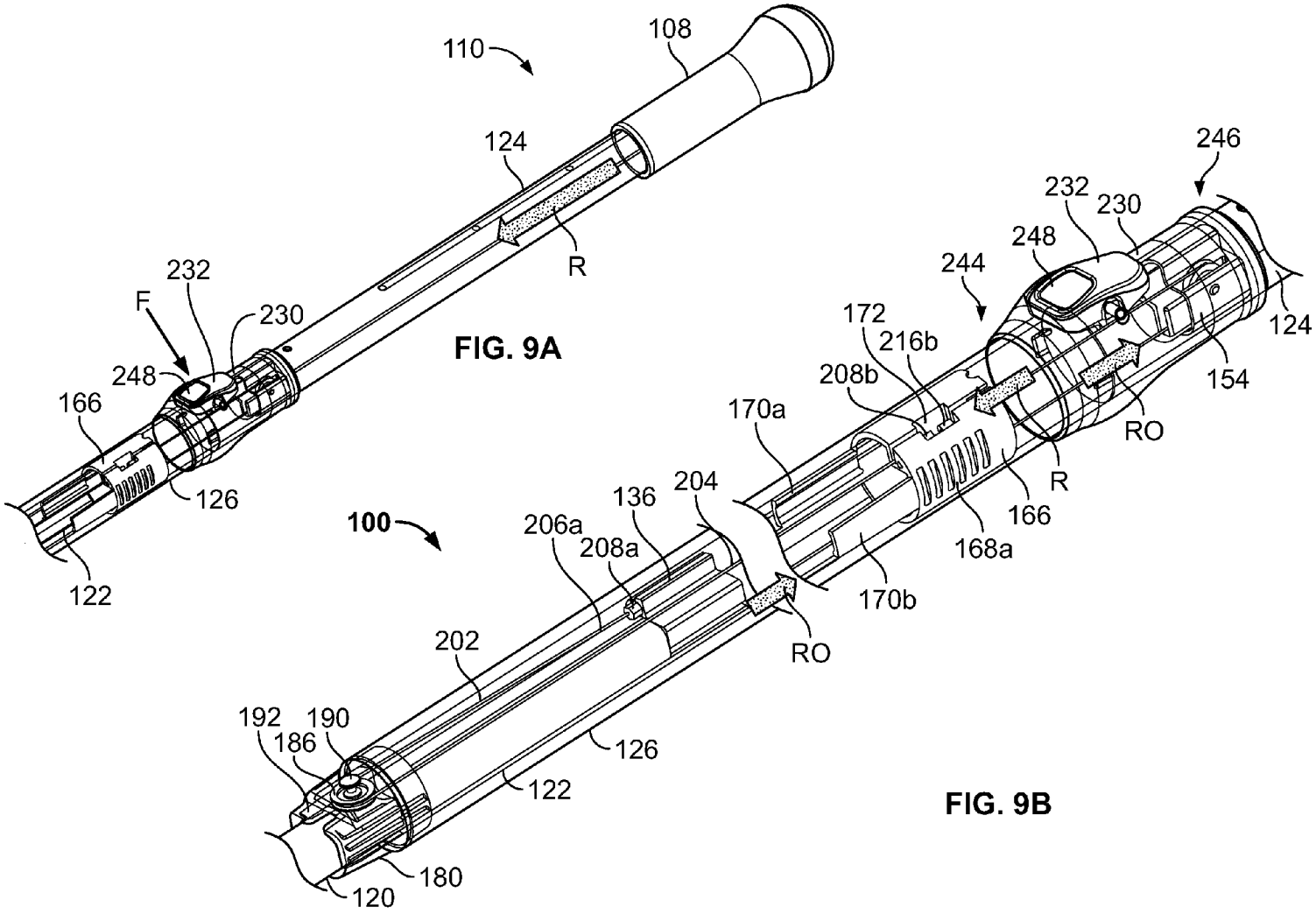
FIGS. 9A & 9B are close-up perspective views of a closing or retracting operation of the extendable stick of FIG. 1.

Turning now to FIGS. 9A-B, the retracting or closing operation of the extendable stick 100 is shown. FIG. 9A illustrates the posterior end 110 when a force F, which may be caused by the user's thumb depressing thereupon, is exerted on the button 232 to allow release of the locking mechanism and movement of the third member 124 and the handle 108 toward the button cap 230 in a retracting direction R. FIG. 9B shows the inner pulley system 134 that occurs. Movement of the handle 108 in direction R pushes the third end cap 166 in the same direction, and thus pulls on the second turnbuckle 216*b* of the posterior string 204 in the same direction R. This exerts a force on the first turnbuckle 216*a* of the posterior string 204 to cause movement of the first end cap 136 in an opposite direction RO, which pulls the first member 120 inwardly.

Figures 10A, 10B:
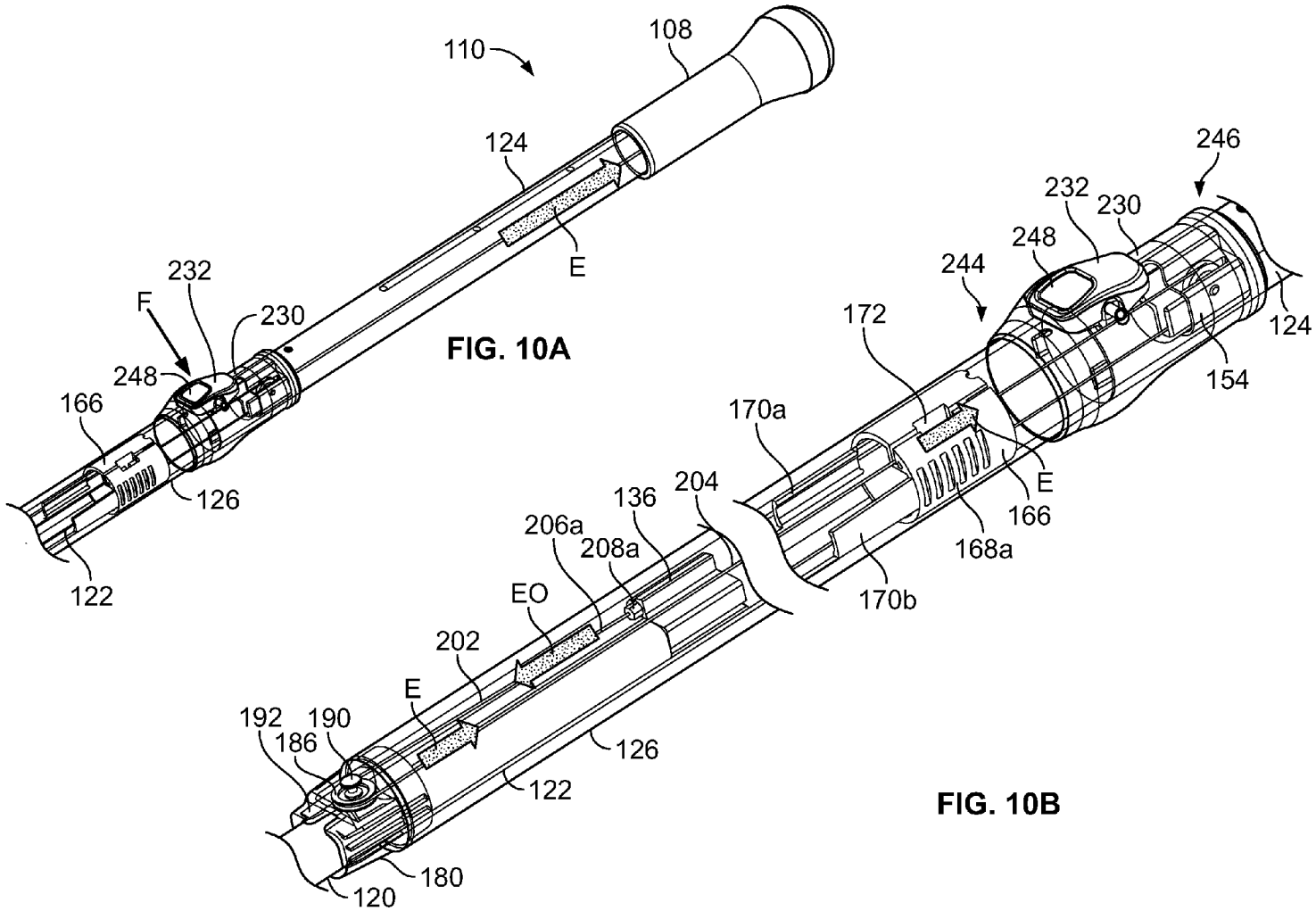
FIGS. 10A & 10B are close-up perspective views of an opening or extending operation of the extendable stick of FIG. 1.

Moving now to FIGS. 10A-B, the extending or opening operation of the extendable stick 100 is shown. FIG. 10A shows the posterior end 110 when the force F is exerted on the button 232 to unlock the locking mechanism and allow the user to pull the handle 108 away from the button cap 230 in a direction E. FIG. 10B shows the pulley system 134 that responds to the user's application of the direction E. In particular, the third member 124 is pulled out of the rearward half 246 of the button cap 230 and third end cap 166 is pulled toward the button 230 in the direction E. This causes the posterior string 204 to travel in the same direction E and pull the anterior string 202 in the opposite direction EO, which causes the first member 120 to be extended out through the step-down portion of the fourth end cap 180.

Figure 11:
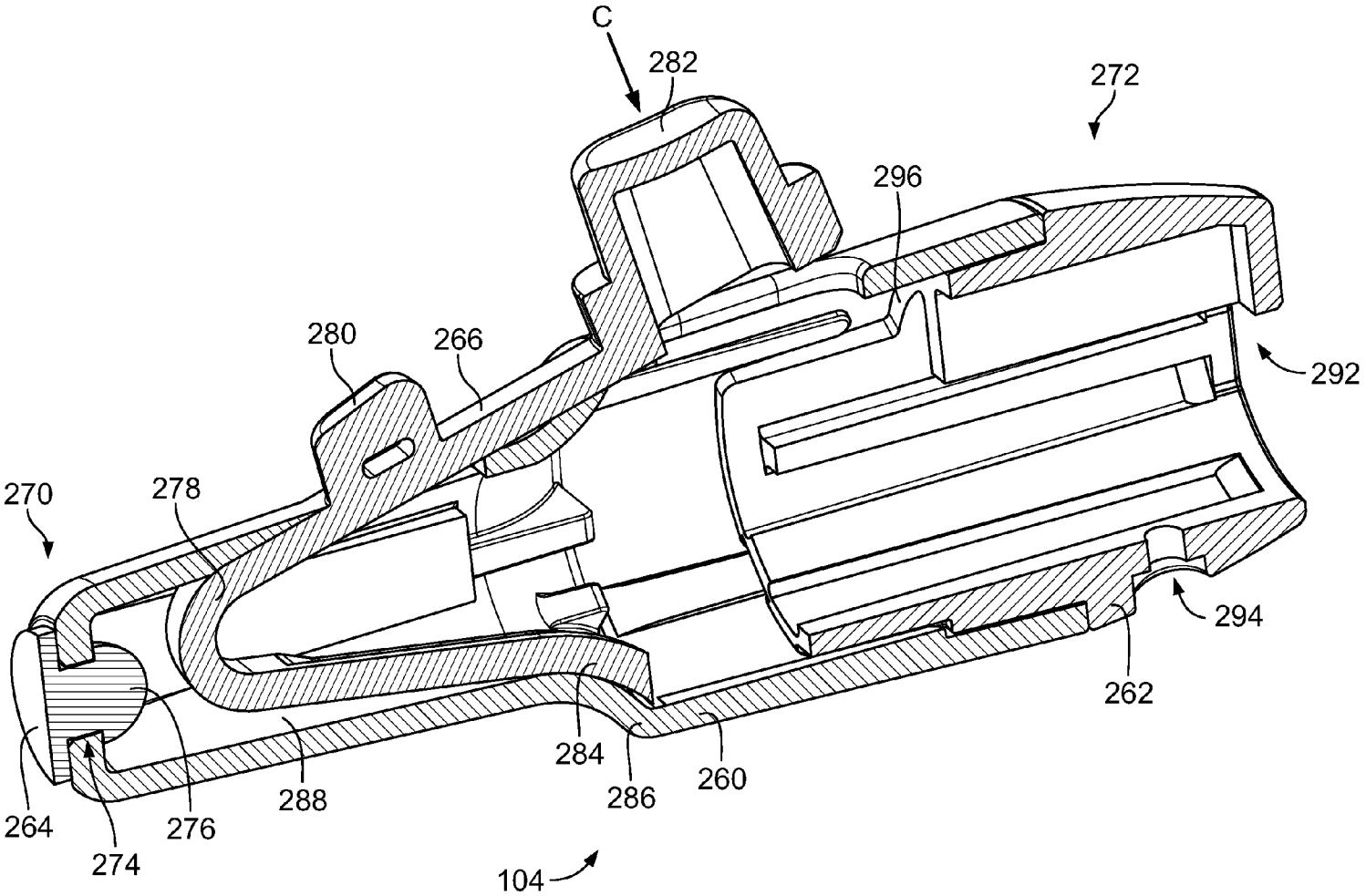
FIG. 11 is a cross-sectional view of an attachment head assembly of the extendable stick of FIG. 1 generally taken along line 11-11 of FIG. 1.

Turning now to FIG. 11, a cross-sectional view of the attachment head 104 is shown. The attachment head body 104 comprises a main body 260 that receives a plug 262 at one end and a bumper 264 at an opposing end. The main body 260 houses a spring 266 inserted therein. In some embodiments, the attachment head 104 further includes an attachment head cover 268 disposed over the main body 260 and/or portions of the plug 262 (see FIGS. 2 and 13A-13C).

In the present embodiment, the main body 260 comprises a connector end 270 and a stick end 272. The connector end 270 includes a tip with a tip orifice 274 for insertion a rounded bulb 276 on the bumper 264 therein. It is contemplated that the rounded bulb 276 operates as a stop for a bend 278 of the spring 266 when the spring 266 is depressed at a connector button 280 and/or a spring button 282. In particular, depression of either button 280,282 causes the spring 266 to temporarily deform and flex at the bend 278 as the spring 266 presses against a hinge 284 that engages a curved wall 286. The depressing force causes the spring 266 to move further into a slot 288 toward the bumper 264. It is contemplated that the bumper 264 prevents the spring 266 entering too far into a spring orifice 290 that can cause the spring 266 to become stuck inside the main body 260.

Still referring to FIG. 11, the plug 262 is inserted at the stick end 272 of the main body 260 and provides an entry orifice 292 for receiving and securing the first member 120.

In the present embodiment, the anterior end 106 of the first member 120 having the cut-out 138 is inserted through the entry orifice 292, which is shaped in corresponding fashion, and further secured by a screw (not shown) provided through a screw hole 294 on the plug 262. Further, it is contemplated that the plug 262 is shaped to accommodate other components within the main body 260, such as a spring cut-out 296 to permit movement of the spring 266 into the main body 260 when depressed.

Figures 13A, 13B, 13C:
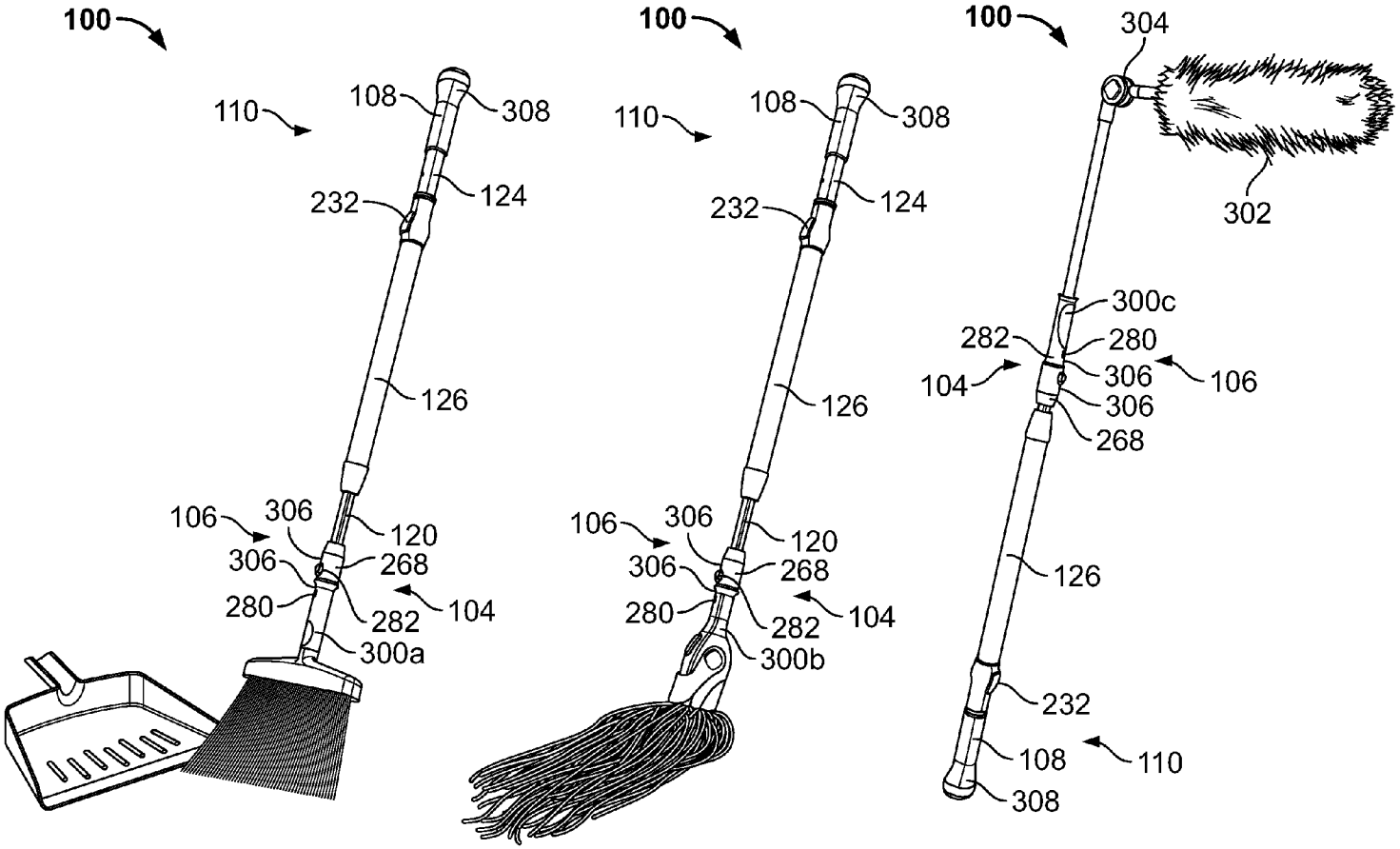
FIGS. 13A, 13B and 13C illustrate a broom head, a mop head, and a sweeper head, respectively, deployed on the extendable mop stick of FIG. 1.

Turning now to FIGS. 13A-13C, various attachment tools are shown that may be deployed on the attachment head 104 of the extendable stick 100. FIG. 13A shows a broom head 300*a* attached to the attachment head 104. FIG. 13B illustrates a mop head 300*b* attached to the attachment head 104. FIG. 13C shows a duster 300*c* attached to the attachment head 104, whereby the duster 300*c* includes a dusting head 302 and a pivot joint 304. The attachment tools 300*a*, 300*b*, 300*c* can each comprise a fitting element that is adapted to be slid onto the connector end 270 (see FIG. 11) of the attachment head 104 and/or the attachment head cover 268. In a particular aspect, the attachment head cover 268 includes a pair of orifices 306 for exposing the connector button 280 and the spring button 282 therethrough. In use, the user slides one of the attachment tools 300*a-c* until an auditory signal, such as a "click" is heard by the user. The auditory signal indicates that the attachment tool 300*a*, 300*b*, 300*c* is properly secured thereon. It is contemplated that the auditory signal is generated by the temporary deformation and resilience of the spring 266 as the connector button 280 locks the attachment tool 300*a-c* thereon. To release the attachment tool 300*a*, 300*b*, 300*c*, the user depresses the spring button 282 in a direction C (see FIG. 11) to release the connector button 280 from the tool 300*a*, 300*b*, 300*c*.

It is contemplated that the extendable stick 100 is universal for a variety of applications and users, including users of different heights who prefer to adjust the length of the stick 100 to ease their use. In the present embodiment, the extendable stick 100 is applied for cleaning instruments and may be regarded as a triple-use cleaning tool. However, other applications can be appreciated by those skilled in the art. Further, it is contemplated that the extendable stick 100 is lightweight and portable to provide quick maneuverability thereof. The handle 108 is ergonomically-formed to offer good grip and prevent slippage from the user's hand. For instance, the handle 108 provides a bulbous-shaped end 308 to prevent the stick from wobbling or slipping from the user's hand. The handle 108 and extendable stick 100 overall is suitable for both left and right handed users. Color coding may also be used to indicate to a user action points on the implements. In one non-limiting example, a red stripe can be placed below the bulbous-shaped end 308, the spring button 282 can be red, and the release lever on the mop head 200*b* can be red. The red stripe indicates where a user can grab the stick; the red spring button 282 indicates an action point when a user wishes to extend or contract the extendable stick 100; and the release lever on the mop head 200*b* indicates where to release the mop head. The red stripe on the handle 108 can be a soft, rubber material that helps with gripping the handle 108 as well as protecting surfaces the stick is leaned up against and stopping the stick from sliding against the wall vertical surface.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides an extendable stick including a first member, a second member, and a third member arranged in a telescopic nesting formation. A pulley system is in operative communication with the first, second, and third members to extend the first member and the third member simultaneously outwardly and retract the first member and the third member simultaneously inwardly. A tool, such as a broom head, a mop head, or a dusting head, can be attached to the first member.

The invention claimed is:

1. An extendable stick, comprising:

an elongate body comprising a first member, a second member, and a third member arranged in a telescopic nesting formation; and a pulley system disposed within the elongate body, wherein the pulley system is in operative communication with the first, second and third members of the elongate body to extend the first member and the third member simultaneously outwardly from the elongate body and retract the first member and the third member simultaneously inwardly from the elongate body, wherein the first, the second, and the third members are nested in order of increasing cross-sectional diameter, whereby the first member defines a smallest diameter and the third member defines a largest diameter, and wherein the elongate body further comprises a fourth member wherein the first, second, and third members are arranged in the telescopic nesting formation within the fourth member when the elongated body is in a collapsed configuration.

2. The extendable stick of claim 1, wherein the second member is stationary.

3. The extendable stick of claim 1 further comprising:

an attachment head disposed on a first end of the first member, wherein the attachment head is configured to receive an attachment tool releasably secured thereto, and a handle disposed on a second end of the third member opposing the first end of the first member.

4. The extendable stick of claim 1, further comprising a button assembly configured to lock the elongate body in a collapsed position, an extended position, and a plurality of positions between the collapsed position and extended position.

5. The extendable stick of claim 1, wherein the first member projects outwards from an anterior end of the fourth member and the third member projects outwards from a posterior end of the fourth member when the elongate body is in an extended configuration.

6. An extendable stick, comprising:

an elongate body comprising a first member, a second member and a third member arranged in a telescopic nesting formation within a fourth member;

an attachment head disposed on a first end of the first member, wherein the attachment head is configured to receive an attachment tool releasably secured thereto;

a handle disposed on a second end of the third member opposing the first end of the first member; and a pulley system disposed within the elongate body, wherein the pulley system includes an anterior wheel disposed within a fourth end cap disposed on a first end of the second member and a posterior wheel disposed within a second end cap disposed on a second end of the second member, and string members in communication with a first end cap, a third end cap, the anterior wheel, and the posterior wheel, wherein in a collapsed configuration the first end cap is proximate the second end cap and the third end cap is proximate the fourth end cap, and in an extended configuration the first end cap is proximate the fourth end cap and the third end cap is proximate the second end cap, and wherein the first member, the second member, and the third member are nested in order of increasing cross-sectional diameter, whereby the first member defines a smallest diameter and the third member defines a largest diameter.

7. The extendable stick of claim 6, wherein the first end cap passes through the third end cap when the elongate body is transitioned from the collapsed configuration to the extended configuration.

8. The extendable stick of claim 7, wherein the first end cap is disposed on a second end of the first member and the third end cap is disposed on the first end of the third member.

9. The extendable stick of claim 6, wherein the second member is stationary within the fourth member.

10. The extendable stick of claim 9, wherein a first end of a first string member is connected to the first end cap and a second end of the first string member is connected to the third end cap, and a first end of a second string is connected to the first end cap and a second end of the second string is connected to the third end cap, and wherein the first string is in communication with the anterior wheel and the second string is communication with the posterior wheel.

11. The extendable stick of claim 6, further comprising a button assembly configured to lock the elongate body in the collapsed position, the extended position, and a plurality of positions between the collapsed position and extended position.

12. An extendable stick, comprising:

an elongate body comprising a first member, a second member, and third member arranged in a telescopic nesting formation, wherein the first member is dimensioned to fit within the second member and the second member is dimensioned to fit within the third member and the third member is fit within a fourth member;

an attachment head disposed on a first end of the first member, wherein the attachment head is configured to receive an attachment tool releasably secured thereto;

a handle disposed on a second end of the third member opposing the first end of the first member;

a button assembly disposed on the fourth member; and a pulley system disposed within the elongate body, wherein the pulley system is in operative communication with the first, second and third members of the elongate body to extend the first member and the third member simultaneously outwardly from the elongate body and retract the first member and the third member simultaneously inwardly from the elongate body, wherein the first, the second, and the third members are nested in order of increasing cross-sectional diameter, whereby the first member defines a smallest diameter and the third member defines a largest diameter.

13. The extendable stick of claim 12, wherein the third member includes a plurality of holes, and wherein the button assembly is configured to be in communication with one of the plurality of holes when the elongate body is configured to be in one of the collapsed position, the extended position, and the plurality of positions between the collapsed position and extended position.

14. The extendable stick of claim 13, wherein the second member is stationary within the fourth member when the first and third members are simultaneously extended or retracted to configure the elongate body in one of the collapsed position, the extended position, and the plurality of positions between the collapsed position and extended position.

15. The extendable stick of claim 14, wherein the attachment tool is one of a broom head, a mop head, and a dusting head.

* * * * *